US010737166B1

(12) United States Patent
Alexandres

(10) Patent No.: US 10,737,166 B1
(45) Date of Patent: Aug. 11, 2020

(54) GOLF PUTTING VENT WITH ADJUSTABLE RAMP

(71) Applicant: Jon K. Alexandres, Urbandale, IA (US)

(72) Inventor: Jon K. Alexandres, Urbandale, IA (US)

( * ) Notice: Subject to any disclaimer, the term of this patent is extended or adjusted under 35 U.S.C. 154(b) by 0 days.

(21) Appl. No.: 16/518,722

(22) Filed: Jul. 22, 2019

(51) Int. Cl.
*A63B 69/36* (2006.01)
*A63B 57/40* (2015.01)

(52) U.S. Cl.
CPC ..... *A63B 69/3676* (2013.01); *A63B 57/40* (2015.10)

(58) Field of Classification Search
USPC ..... 473/159, 163, 178, 180
See application file for complete search history.

(56) References Cited

U.S. PATENT DOCUMENTS 3,310,312 A 3/1967 Peeples
3,610,631 A * 10/1971 Mulherin ..... A63B 67/02 473/181
3,897,059 A 7/1975 McCulloch et al.
4,275,886 A * 6/1981 Bannon ..... A63B 57/40 473/180
4,563,009 A 1/1986 Nagasaki et al.
5,120,063 A * 6/1992 Birchler ..... A63B 57/357 473/180
5,205,559 A 4/1993 Plopper
5,275,405 A * 1/1994 Ridge ..... A63B 57/357 473/180
D365,618 S * 12/1995 King ..... D21/790
5,620,375 A 4/1997 Frotten
5,997,407 A * 12/1999 Alexandres ..... A63B 57/357 473/180
6,193,613 B1 2/2001 Alexandres
6,626,767 B2 * 9/2003 Lawlyes ..... A63B 69/3661 473/180
8,864,596 B1 * 10/2014 Maranian, Jr. ..... A63B 69/3661 473/162
2010/0022318 A1 * 1/2010 Munaretto ..... A63B 57/357 473/196

* cited by examiner

*Primary Examiner* — Nini F Legesse
(74) *Attorney, Agent, or Firm* — Fish & Richardson P.C.

(57) ABSTRACT

Golf putting practice devices and methods are described that can be used to practice putting indoors on a flat surface or in an opening in the floor. For example, some example golf putting practice devices described herein may include a ball receptacle, a frame, and a ramp. The ball receptacle has one or more walls defining a cavity sized to receive a golf ball. The frame has multiple openings to allow a flow of air when the device is placed over an opening in the floor, such as a duct outlet of a forced air circulation system. The ramp of the device may be adjustable between different lengths.

20 Claims, 4 Drawing Sheets

GOLF PUTTING VENT WITH ADJUSTABLE RAMP

TECHNICAL FIELD

This document generally describes a golf putting practice device and related methods, such as methods for using the golf putting practice device.

BACKGROUND

Golf putting practice devices are commonly used to practice putting indoors. Some golf putting devices have been configured to sit on a floor surface or in an existing opening, such as a floor vent, and may include a receptacle that simulates a golf hole.

SUMMARY

Some embodiments described herein include a golf putting practice device and related methods. For example, an example golf putting device may be configurable for use on a flat surface as well as in a floor duct vent (e.g., of a forced air circulation system of a building). In some optional embodiments, a device for golf putting includes a ball receptacle having one or more walls that define a cavity sized to receive a golf ball and a substantially open top, and a frame at least partially surrounding the ball receptacle. The frame may include a plate member that extends outward from an upper portion of the one or more walls of the ball receptacle. The plate member may include a plurality of openings configured to allow a flow of air through the plate member (e.g., when the device is placed over a duct outlet of a forced air circulation system). A ramp may be attached to the one or more walls of the ball receptacle and adjustable between a first length and a second length.

Some example golf putting devices described herein are adjustable for use with multiple sizes of floor vents. For example, in some embodiments, the golf putting device includes a removable and/or adjustable ramp. The ramp is removable or adjustable in length such that the device is positionable for use within a floor duct having a first width when the ramp is removed/adjusted to the first length and positionable for use within a floor duct having a second width when the ramp is adjusted to the second length. In some optional embodiments, the ramp can include a first ramp portion and a second ramp portion that are movable relative to one another, and/or the first and second ramp portions may be made of the same or different materials (e.g., the first ramp portion is optionally made from a plastic and the second ramp portion is optionally made from a paper). The second ramp portion optionally can be slidably engaged with the first ramp portion. In some embodiments, the first ramp portion can include grooves on opposite sides of the first ramp portion, and the second ramp portion is slidable along the grooves. The second ramp portion can also have a width equal to a width of the first ramp portion.

Some example golf putting devices are configured such that no frame portion extends in front of the ramp/ball receptacle when positioned for use. A golf ball can thus roll into the receptacle (e.g., via the ramp) directly from the putting surface. The ramp can also be slidable relative to a portion of the ball receptacle to adjust between the first length and the second length. The device can further include one or more protrusions on at least one of a back side of the frame and a back side of the ball receptacle. A bottom of the ball receptacle can include an opening configured to allow for a flow of air. In other embodiments, the golf putting device can include a pair of plate members that extend perpendicularly outward from an upper portion of the one or more walls of the ball receptacle. The pair of plate members can also be equally sized.

Particular embodiments described herein include a method for using a device for golf putting, the method comprising: placing the device into a floor duct, the device having: a ball receptacle having one or more walls that define a cavity sized to receive a golf ball and a substantially open top; a frame at least partially surrounding the ball receptacle, wherein the frame includes a plate member that extends outward from an upper portion of the one or more walls of the ball receptacle, wherein the plate member comprises a plurality of openings configured to allow a flow of air through the plate member when the device is placed over a duct outlet of a forced air circulation system; and a ramp attached to the one or more walls of the ball receptacle and adjustable between a first length and a second length; and extending the ramp in length such that the device is positionable for use within a floor duct having a first width when the ramp is adjusted to the first length and positionable for use within a floor duct having a second width when the ramp is adjustable to the second length. The method described herein can optionally include removing the ramp such that the device is positionable for use within a floor duct having a third length. In some embodiments of the method for using the golf putting device, the ramp of the device can include a first ramp portion and a second ramp portion.

Particular embodiments described herein include a method for using a device for golf putting, the method comprising placing the device on a flat surface, the device having a ball receptacle having one or more walls that define a cavity sized to receive a golf ball and a substantially open top; a frame at least partially surrounding the ball receptacle, wherein the frame includes a plate member that extends outward from an upper portion of the one or more walls of the ball receptacle, wherein the plate member comprises a plurality of openings configured to allow a flow of air through the plate member when the device is placed over a duct outlet of a forced air circulation system; a ramp attached to the one or more walls of the ball receptacle and adjustable between a first length and a second length; and adjusting the ramp in length such that the device is positionable for use on the flat surface.

In some embodiments of the method for using the golf putting device, the ramp of the device is slidable relative to a portion of the ball receptacle to adjust between the first length and the second length. The device can further comprise one or more protrusions on at least one of a back side of the frame and a back side of the ball receptacle that are configured to prop up the device on the flat surface.

The device and methods described herein may provide one or more of the following advantages. First, some embodiments described herein provide a golf putting device that can be used in multiple different configurations. For example, the golf putting device includes one or more features that are adjustable/removable to accommodate positioning in different orientations that can receive a golf ball, such as in a floor duct vent or upright on a floor, and/or that make it possible to fit the golf putting device into floor ducts having different sizes and/or widths. The device may be readily adjustable (e.g., without tools) to fit into different floor ducts by removing the ramp altogether, changing the length of the first and/or second ramp portions to cover a width of the floor duct relative to the ball receptacle, or removing the first and/or second ramp portions. Second, some embodiments described herein facilitate use of the golf putting device on a flat surface such as a carpet, rug, or wooden floor. The ramp can be adjusted to extend over a range of surfaces, thereby providing for a smooth, unobstructed path of a golf ball from the flat surface to the ball receptacle. Third, some embodiments described herein include one or more features that stabilize the golf putting device when receiving a golf ball. For example, some embodiments include one or more protrusions, such as pins made from a plastic, on at least one of the back side of the frame of the device and the back side of the ball receptacle, such that the golf putting device can stand up on a surface (e.g., a flat carpeted surface) without moving or tipping over when a ball goes into the ball receptacle or makes contact with a portion of the golf putting device. Fourth, the embodiments described herein make the golf putting device transformable to provide for easier putting practice in a multitude of indoor layouts, including on a flat surfaces (e.g., carpets of varying thickness) or in a floor duct of a forced air circulation system.

The details of one or more implementations are set forth in the accompanying drawings and the description below. Other features and advantages will be apparent from the description and drawings, and from the claims.

DETAILED DESCRIPTION OF ILLUSTRATIVE EMBODIMENTS

Figure 1A:
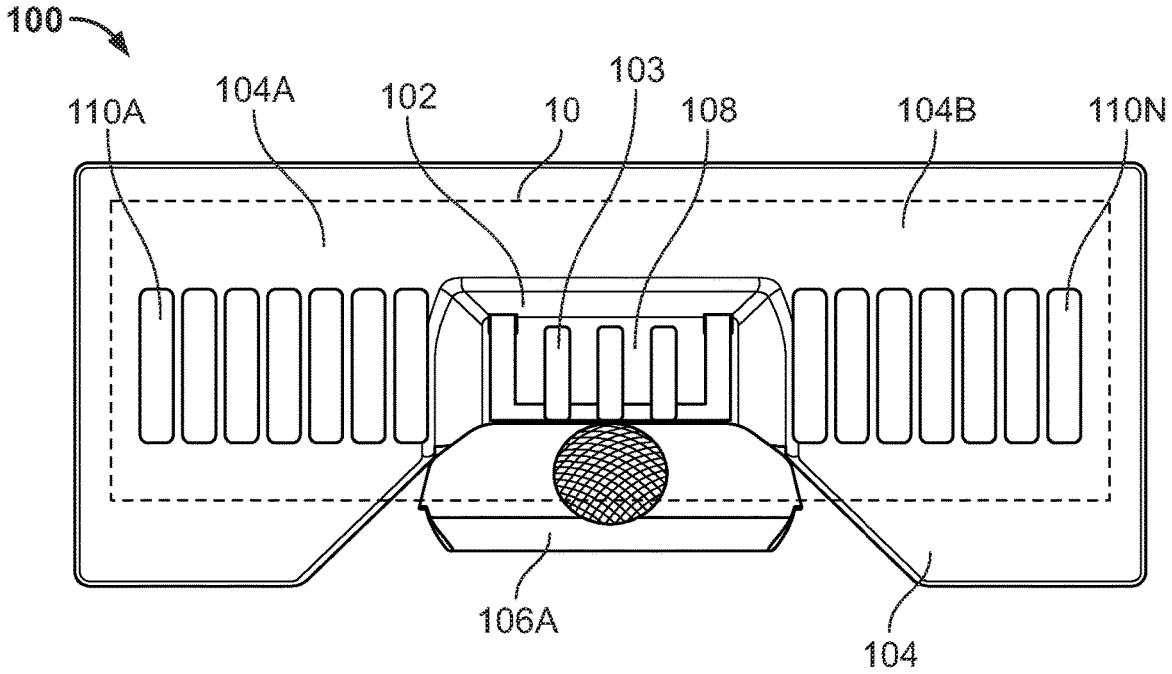
FIGS. 1A-1B are front perspective views of an example golf putting practice device in a floor duct.
Figure 1B:
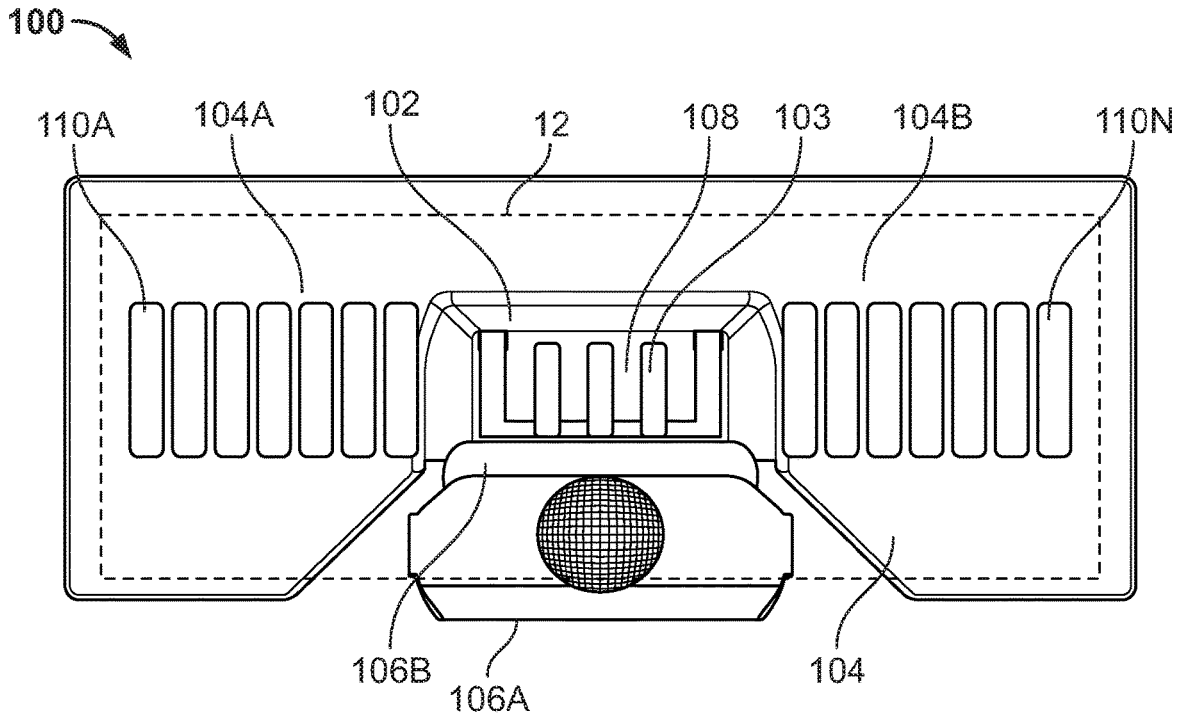

Referring to FIGS. 1A and 1B, an example golf putting practice device 100 is shown that can be positioned in a floor duct. The device 100 can serve as a substitute for a floor vent that fits into a floor duct of a forced air circulation system of a building. In this example, the device 100 has one or more walls 102 that define a cavity of a ball receptacle 108 that is sized to receive a golf ball. The ball receptacle 108 can have a substantially open top and a multitude of openings 103 to allow for the continuous flow of air when the device 100 is placed in a floor duct. The device 100 can further include a frame 104 at least partially surrounding the receptacle 108, wherein the frame includes plate members 104A-B that extend outward from the ball receptacle 108, as depicted in FIG. 1A, for example. In an example embodiment, the frame does not completely surround the receptacle 108. For example, the frame can have no portion that extends in front of a ramp that is part of the device 100.

Each plate member 104A-B can have one or more openings 110A-N (e.g., a plurality of apertures) that are in parallel alignment with one another and configured to allow or provide for passage of air out of a floor duct when the device 100 is placed in the floor duct. The plate members 104A-B can also extend perpendicularly outward from an upper portion of one or more walls of the ball receptacle 108. In the preferred embodiment, the plate members 104A-B can be equally sized and/or of a same length so that the ball receptacle 108 is generally centered in the device 100. Alternatively, the ball receptacle 108 may be offset and/or the plate members 104A-B may be of different lengths, sizes. In some embodiments, only one of the plate members 104A-B may be included, and/or the ball receptacle 108 can be located at one end of the device 100 (e.g. rather than in the center of the device 100). Alternatively or additionally, the plate members 104A-B can be of different sizes, widths, and/or lengths, such as to compensate for differently shaped and/or sized floor ducts.

The device 100 includes a ramp 106, which can be attached to one or more walls 102 of the ball receptacle 108. The ramp 106 may include multiple ramp portions, such as a first ramp portion 106A, and a second ramp portion 106B. The first ramp portion 106A can be slidably engaged with a portion of the ball receptacle 108 and/or the second ramp portion 106B, as depicted in FIG. 1B, for example. The first ramp portion 106A can be adjusted in length relative to a portion of the ball receptacle 108 so that a user of the device 100 can practice golf putting using the device 100 in range of floor duct sizes. For example, in FIG. 1A, the device 100 is placed in a floor duct with a relatively smaller perimeter 10. As a result, the first ramp portion 106A is configured at a first length that covers a gap between the relatively smaller perimeter 10 and the ball receptacle 108. This allows for a smooth flow of a ball that is putted into the ball receptacle 108. The first ramp portion 106A doesn't have to be extended or slidably adjusted relative to the ball receptacle 108 to cover a larger gap (e.g., space, width, etc.) between the ball receptacle 108 and the floor duct.

The ramp 106 may be made from one or more materials. In an example embodiment, the first ramp portion 106A may be made from a first material and the second ramp portion 106B may be made from a second material that is different than the first material. For example, the first ramp portion 106A may be made of a paper material, and the second ramp portion 106B may be made from a plastic, such as a relatively rigid plastic. The first ramp portion 106A may be a paper sleeve that at least partially slips over the second ramp portion 106B. In an example embodiment, the one or more walls 102, frame 104, and second ramp portion 106A are made from the second material, and or may be integrally formed as a unitary component.

FIG. 1B depicts another example of the embodiment in FIG. 1A. In this example, the device 100 is positioned into a floor duct having a relatively larger perimeter 12. To compensate for the width of the large perimeter 12, the first ramp portion 106A is extended outwardly from the receptacle 108 and/or second ramp portion 106B. The second ramp portion 106B can be made from a plastic and can be attached to one or more walls of the ball receptacle 108. The first ramp portion 106A can be slidably engaged with the second ramp portion 106B so that the first ramp portion 106A can extend to a second length to cover a gap (e.g., space, width, etc.) between the receptacle 108 and the perimeter of the floor duct. The first ramp portion 106A may at least partially envelope the second ramp portion 106B, and may have a width that is greater than a width of the second ramp portion 106B.

Alternatively or additionally, the ramp 106 and/or other portions of device 100 can include one or more features that interact to allow at least a portion of ramp 106 to move between first and second positions. For example, the second ramp portion 106B can include one or more grooves (e.g., on opposite sides of the first ramp portion 106B) so that the first ramp portion 106A can be slidable along those grooves. The first ramp portion 106A can further have a width equal to a width of the first ramp portion 106B.

Figure 2:
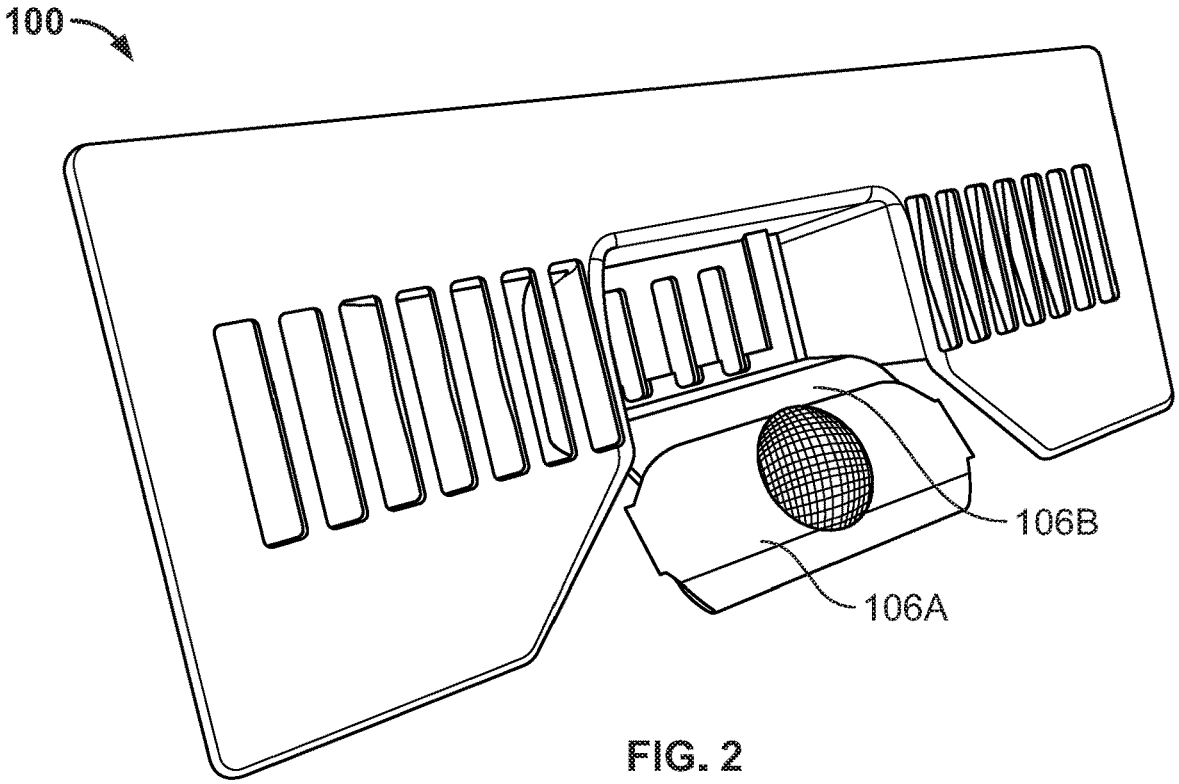
FIG. 2 is a perspective view of the example golf putting practice device of FIGS. 1A-1B, showing an extended second portion of a ramp on a flat surface.
Figure 3:
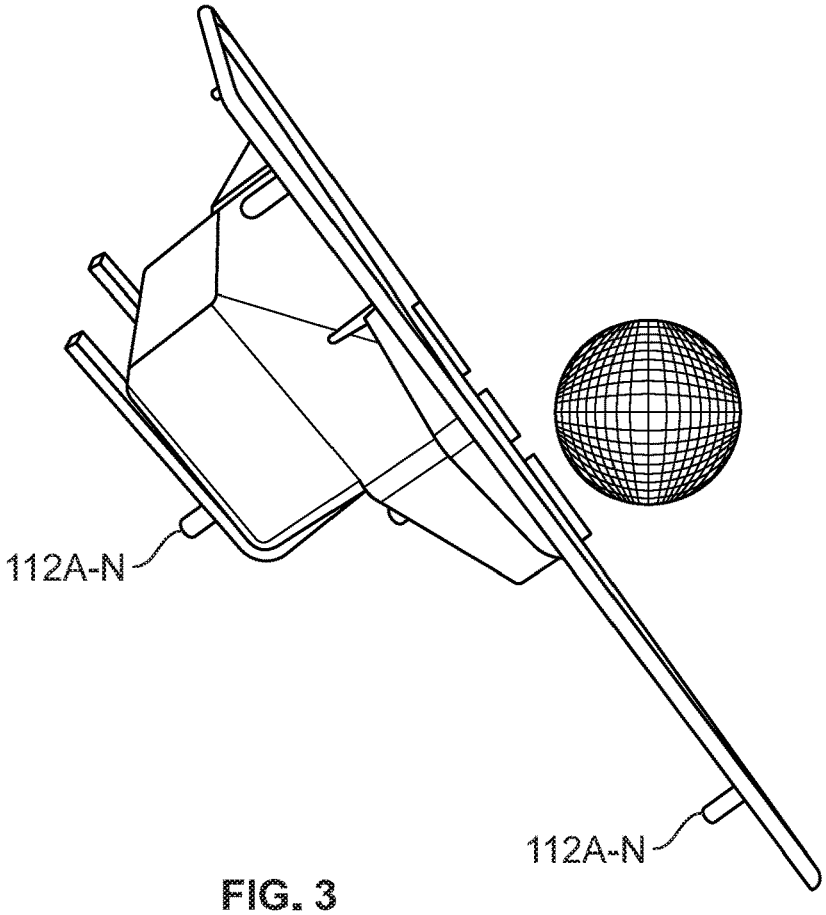
FIG. 3 is a perspective view of the example golf putting practice device of FIGS. 1A-1B, showing one or more protrusions used to stand the device on a flat surface.

FIG. 2 is a perspective view of the example golf putting practice device of FIGS. 1A-1B, showing an extended first portion 106A of the ramp 106 on a flat surface. In this example, the device 100 is positionable on a flat surface, such as a wooden floor or carpet, to be used for putting practice while in an angled/partially upright position. This example embodiment facilitates use of the device 100 in horizontal configurations (e.g., positioned in a floor vent) and in angled/upright positions, such as where the user does not have access to a floor duct or prefers use of device 100 independent of a floor duct. In other words, the same device 100 in FIGS. 1A-1B can be taken out of a floor duct then placed on the flat surface, and vice versa. The device 100 can further include one or more protrusions (e.g., pins) on at least a back side of the frame and a back side of the ball receptacle 108 (as shown in FIG. 3, for example). The protrusions can enhance the stability of the device 100 in an angled/upright position, such that the device 100 can receive a golf ball without tipping or substantially moving out of a desired practice position. The one or more protrusions do not have to be removed from the device 100 or adjusted in order to position the device 100 into a floor duct, further streamlining the adjustability of the device between the horizontal floor duct configuration and angled/upright configuration.

Still referring to FIG. 2, the first ramp portion 106A is extended out from the second ramp portion 106B in order to cover a distance (e.g., width, gap, space, etc.) between the ball receptacle 108 and the flat surface. As a result, the user can practice putting a golf ball into the ball receptacle 108 without any obstructions in front of the device 100. The second ramp portion 106A allows for the user to practice putting on surfaces that include very short, thin carpets and rugs and relatively thicker carpets. In some embodiments, the first ramp portion 106A may "automatically" adjust to an appropriate length to accommodate the floor surface that the device is positioned on. For example, the first ramp portion 106A may slide outwardly by the force of gravity until it reaches the floor surface, and thus require limited or no manual adjustment beyond simply positioning the entire device 100 on the floor surface.

FIG. 3 is a perspective view of the example golf putting practice device of FIGS. 1A-1B, showing one or more protrusions 112A-N. The protrusions 112A-N can be integrated into the back side of the ball receptacle 108 and/or the frame of the device 100 so that the user can practice putting into the ball receptacle 108 whether the device 100 is placed into a floor duct or positioned on a flat surface. When the device 100 is placed on the flat surface, the protrusions 112A-N are positioned in such a way that the device 100 is resistant to tipping or falling over when a golf ball comes into contact with any part of the device 100 during putting. The protrusions 112A-N can be supporting extension pins with a length of 0.5000" and a diameter of 0.1875" and positioned on the back side of the ball receptacle 108. The protrusions 112A-N can also be any other length sufficient to provide stabilization of the device 100 on a flat surface such as a carpet, rug, or wood flooring. The protrusions 112A-N prevent the device 100 from tipping backwards or falling over when a golf ball hits and/or rolls into the ball receptacle 108 while the device 100 is being used on the flat surface.

Figure 4:
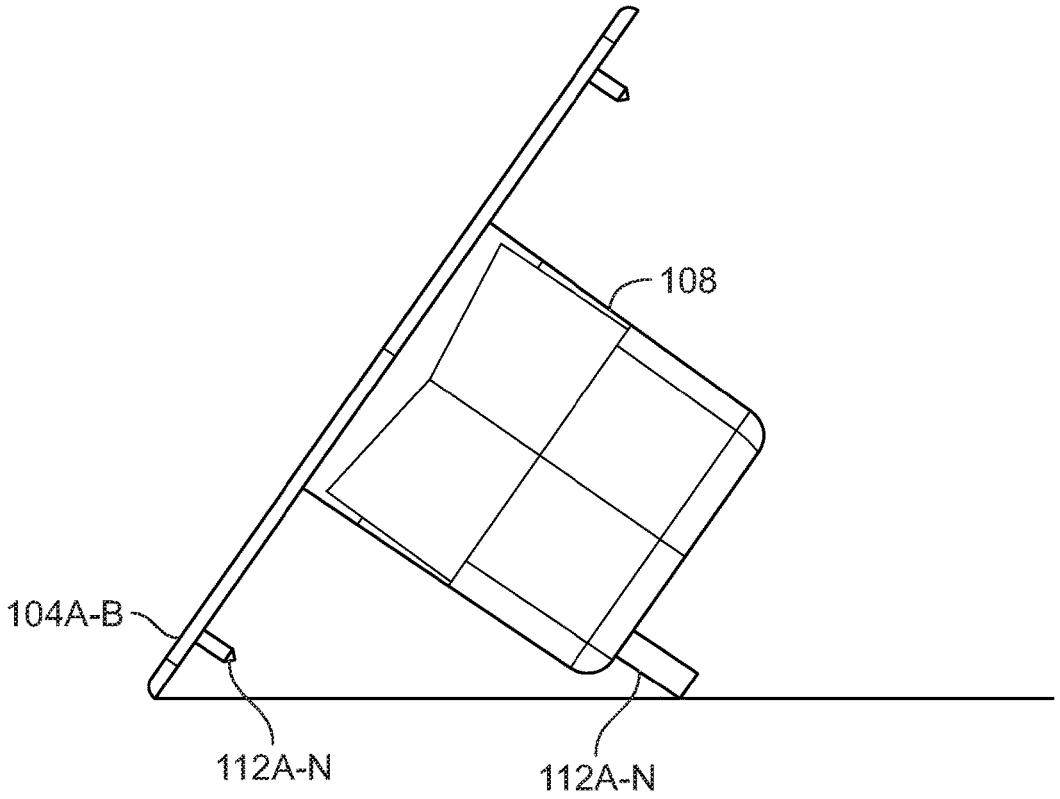
FIG. 4 is a partial cross-sectional view of the example golf putting practice device of FIGS. 1A-1B, showing one or more protrusions used to stand the device on a flat surface.

FIG. 4 is a partial cross-sectional view of the example golf putting practice device of FIGS. 1A-1B, showing the protrusions 112A-N used to stand or prop up the device 100 on a flat surface. This side view of the device 100 depicts the ball receptacle 108 relative to the flat surface when the device 100 is at least partially supported by the protrusions 112A-N (e.g., pins). In some examples, the device 100 can stand on the flat surface using only one or more protrusions 112A-N positioned on the back of the frame of the device 100 and/or the back of the ball receptacle 108. In other examples, the device 100 can stand on the flat surface using one or more protrusions 112A-N positioned on the back of the frame and/or the back of the ball receptacle 108 as well as the plate members 104A-B. In other words, in some example embodiments, the protrusions 112A-N are not be positioned on a back side of the plate members 104A-B but only on the back of the frame 104 and/or the ball receptacle 108. For example, as depicted in FIG. 4, the device 100 stands on the flat surface by resting on (1) two protrusions 112A-N positioned on the back of the ball receptacle 108 and (2) the plate members 104A-B.

Figure 5:
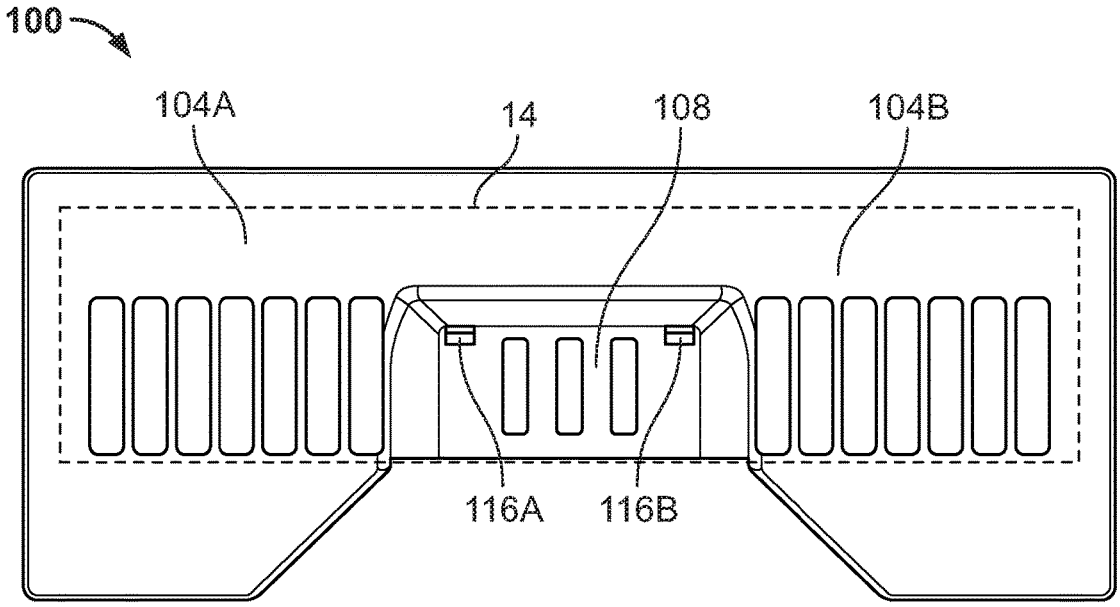
FIG. 5 is a front perspective view of the golf putting practice device of FIGS. 1A-1B, showing the device in a floor duct and without a ramp.

FIG. 5 is a front perspective view of the golf putting practice device of FIGS. 1A-1B, showing the device 100 in a floor duct and without a ramp. In this example, the device 100 is placed into the floor duct having a narrow perimeter 14. The first ramp portion 106B and the second ramp portion 106A are removed from the device 100 or detached from the ball receptacle 108 so that the user can practice putting a golf ball into the ball receptacle 108 without any obstructions. Removal of the first and second ramp portions 106A-B facilitates alignment of a front wall of the ball receptacle 108 with a front portion of the floor duct having a narrow perimeter 14. There is little or no gap of space (e.g., a gap less than half the width of a golf ball) between the front wall of the ball receptacle 108 and the front portion of the floor duct. This allows for seamless and easy putting practice no matter the width/perimeter of a floor duct that the user places the device 100 into, and may more closely simulate putting on a natural putting green even when practicing indoors on an artificial surface.

In some examples, the second ramp portion 106B can be slidably engaged with one or more grooves 116A-B in the ball receptacle 108. For example, the second ramp portion 106B can be snapped or slid out of the grooves 116A-B in the ball receptacle 108 to remove the first ramp portion 106B. This facilitates easy removal and or adjustment of ramp 106. When the second ramp portion 106B is positioned in the grooves 116A-B, the second ramp portion 106B can be held in place such that any interaction with a golf ball will not cause the second ramp portion 106B to shift, move, or detach from the ball receptacle 108. This configuration also allows for easy removal of the second ramp portion 106B so that the device 100 can be fitted/placed into one or more floor ducts having different perimeters.

Figure 6:
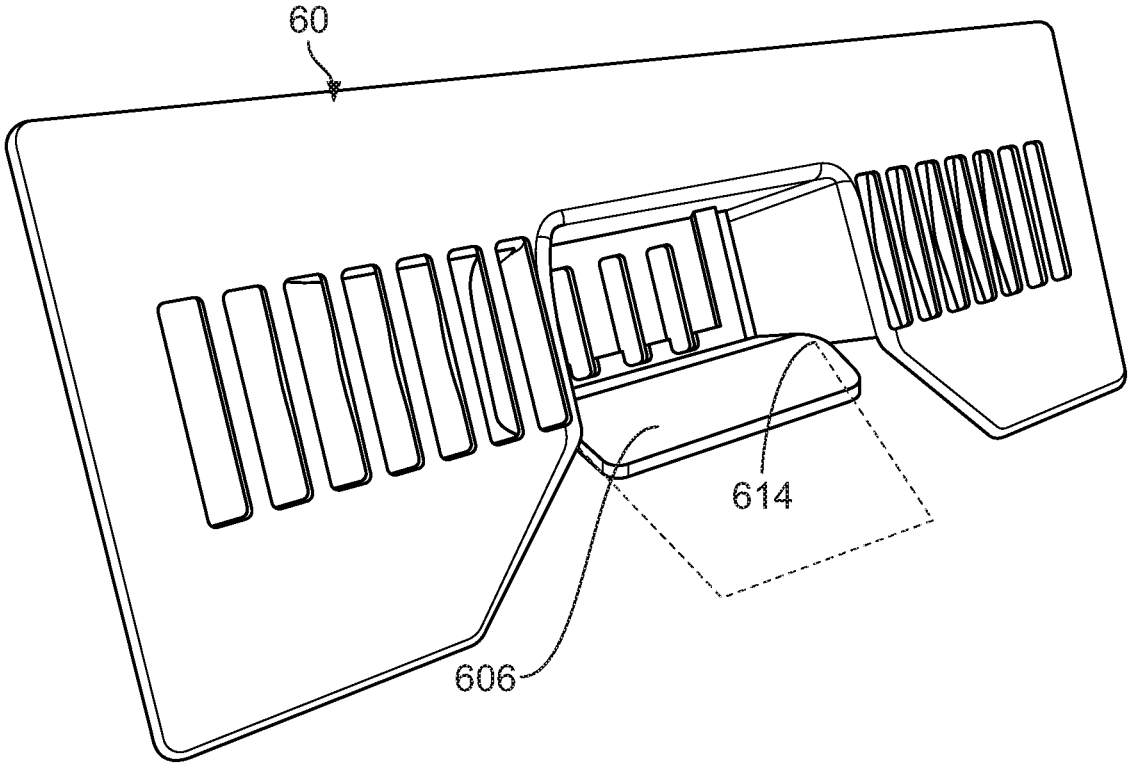
FIG. 6 is a perspective view of an example golf putting practice device having a unitary ramp.

FIG. 6 is a perspective view of an example golf putting practice device 60 on a flat surface with a unitary ramp 606 in a retracted (solid) and extended (broken line) configuration. In various example embodiments, the golf putting practice device 60 may have one or more features similar to golf putting practice device 100 described with respect to FIGS. 1-5.

The unitary ramp 606 can be made from a plastic. Instead of, or in addition to, attaching a second ramp portion, the unitary ramp 606 can be adjusted in length relative to a ball receptacle by an extension 614. The extension 614 demonstrates a second length that the unitary ramp 606 can be extended to such that the user can practice putting a golf ball into the ball receptacle without any obstructions or gap (e.g., space, width) between the cavity of the ball receptacle and the flat surface that the device 60 is positioned on.

In some examples, the second ramp portion can be attached to the unitary ramp 606 to extend between the ball receptacle and the flat surface that the device 60 is placed on. The unitary ramp 606 can then be extended to a second length (e.g., similar to the examples described throughout this disclosure). The second ramp portion can also be extended to the extension 614 by sliding along one or more grooves on opposite sides of the cavity of the ball receptacle.

Figure 7:
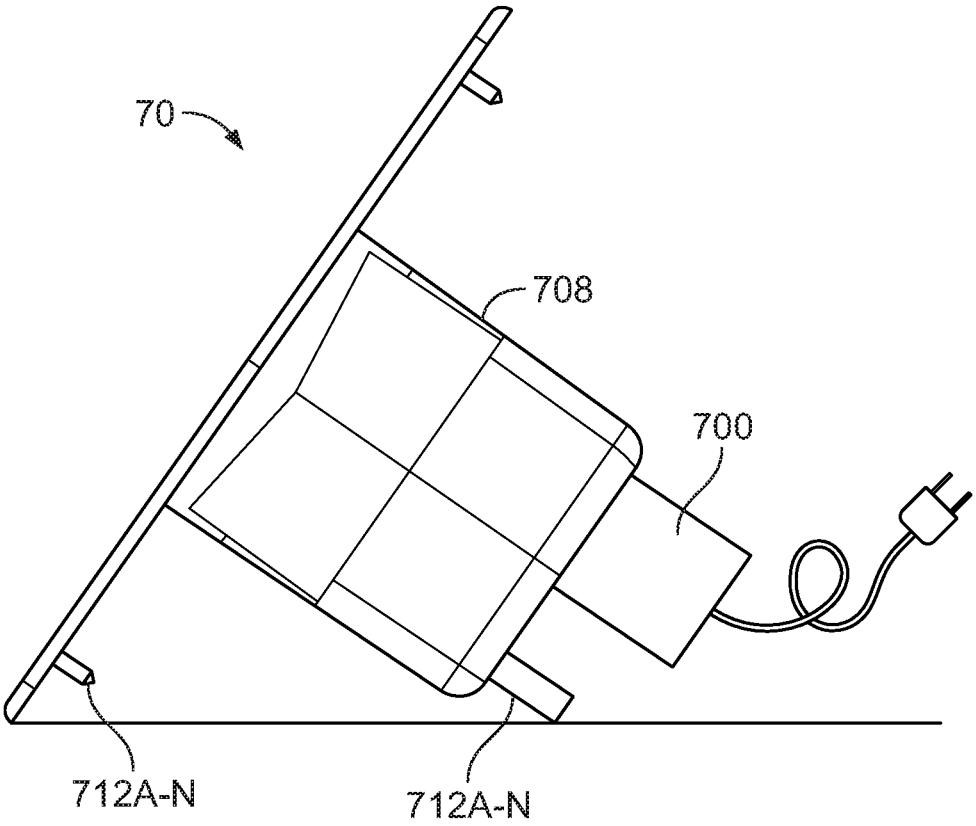
FIG. 7 is a cross-sectional view of an example golf putting practice device having a ball return mechanism.

FIG. 7 is a cross-sectional view of an example golf putting practice device 70 on a flat surface with a ball return mechanism 700. The ball return mechanism 700 is configured to eject a golf ball out of the ball receptacle 708. In various example embodiments, the golf putting practice device 70 may have one or more features similar to golf putting practice device 100 and 60 described with respect to FIGS. 1-6.

The mechanism 700 can have a solenoid actuated by a trigger activated by the golf ball. The trigger can be operated through a visual or mechanical sensing of the presence of the golf ball, for example. Upon actuation of the mechanism 700 by the trigger, the ball is driven upwardly against a rear wall of the ball receptacle 708, which directs the golf ball back towards the user.

In operation of the device 70, the user can place the device 70 into a floor duct and extend the first and/or second ramp portions in length such that the device 70 is positionable for use within a floor duct having a first width when the first and/or second ramp portions are adjusted to the first length and positionable for use within a floor duct having a second width when the first and/or second ramp portions are adjustable to the second length. In operation, the user can also remove the first and/or second ramp portions so that the device 70 is positionable for use within a floor duct having a third length (refer to FIG. 5). In some embodiments, the device 70 may have one ramp or the ramp of the device 70 can comprise the first ramp portion 706B and the second ramp portion as previously described throughout this disclosure.

Alternatively, the user can place the device 70 upright on a flat surface to practice putting golf where the user does not have a floor duct to place the device 70 into. The user can then adjust the first and/or second ramp portions in length such that the device 70 is positionable for use on the flat surface. The device 70 would be stable and upright on the flat surface based on the one or more protrusions 712A-N, as previously described throughout this disclosure, that are positioned on at least one of a back side of the frame of the device 70 and a back side of the ball receptacle 708. When the user practices putting, the first and/or second ramp portions serve as a putting target and a golf ball can roll directly into the cavity of the ball receptacle 708. The golf ball drops down to a bottom wall of the ball receptacle 708 and in some embodiments (refer to FIG. 7), that engages the ball return mechanism 700 to return the golf ball to the user as previously described.

While this specification contains many specific implementation details, these should not be construed as limitations on the scope of the disclosed technology or of what may be claimed, but rather as descriptions of features that may be specific to particular embodiments of particular disclosed technologies. Certain features that are described in this specification in the context of separate embodiments can also be implemented in combination in a single embodiment in part or in whole. Conversely, various features that are described in the context of a single embodiment can also be implemented in multiple embodiments separately or in any suitable subcombination. Moreover, although features may be described herein as acting in certain combinations and/or initially claimed as such, one or more features from a claimed combination can in some cases be excised from the combination, and the claimed combination may be directed to a subcombination or variation of a subcombination. Similarly, while operations may be described in a particular order, this should not be understood as requiring that such operations be performed in the particular order or in sequential order, or that all operations be performed, to achieve desirable results. Particular embodiments of the subject matter have been described. Other embodiments are within the scope of the following claims.

What is claimed is:

1. A device for golf putting, comprising:

a ball receptacle having one or more walls that define a cavity sized to receive a golf ball and a substantially open top;

a frame at least partially surrounding the ball receptacle, wherein the frame includes a plate member that extends outward from an upper portion of the one or more walls of the ball receptacle, wherein the plate member comprises a plurality of openings configured to allow a flow of air through the plate member when the device is placed over a duct outlet of a forced air circulation system; and a ramp attached to the one or more walls of the ball receptacle and adjustable between a first length and a second length; the ramp positionable within the duct outlet to extend at least partially between the ball receptacle and a perimeter of the duct outlet; and wherein no portion of the frame extends in front of the ramp when the ramp is positioned within the duct outlet.

2. The device of claim 1, wherein the ramp is adjustable in length such that the device is positionable for use within a floor duct having a first width when the ramp is adjusted to the first length and positionable for use within a floor duct having a second width when the ramp is adjusted to the second length.

3. The device of claim 1, wherein the ramp comprises a first ramp portion and a second ramp portion.

4. The device of claim 3, wherein the second ramp portion is made from a paper.

5. The device of claim 3, wherein the second ramp portion has a width equal to a width of the first ramp portion.

6. The device of claim 3, wherein the first ramp portion is made from a plastic.

7. The device of claim 1, wherein the ramp is slidable relative to a portion of the ball receptacle to adjust between the first length and the second length.

8. The device of claim 1, further comprising one or more protrusions on at least one of a back side of the frame and a back side of the ball receptacle.

9. The device of claim 8, wherein the protrusions are configured to prop up the device on a flat surface such that the plate member is angled relative to the flat surface, and wherein the ramp defines a path for a ball to roll from the flat surface, upwardly along the ramp, and into the ball receptacle without traversing a portion of the frame.

10. The device of claim 8, wherein when the device is positioned in the floor duct, the ramp defines a path for a ball to roll from the flat surface, downwardly along the ramp, and into the ball receptacle without traversing a portion of the frame.

11. The device of claim 1, wherein a bottom of the ball receptacle has an opening configured to allow for a flow of air.

12. The device of claim 1, further comprising a pair of plate members that extend perpendicularly outward from an upper portion of the one or more walls of the ball receptacle.

13. The device of claim 12, wherein the pair of plate members are equally sized.

14. The device of claim 1, wherein the second ramp portion is slidably engaged with the first ramp portion.

15. A device for golf putting, comprising:

a ball receptacle having one or more walls that define a cavity sized to receive a golf ball and a substantially open top;

a frame at least partially surrounding the ball receptacle, wherein the frame includes a plate member that extends outward from an upper portion of the one or more walls of the ball receptacle, wherein the plate member comprises a plurality of openings configured to allow a flow of air through the plate member when the device is placed over a duct outlet of a forced air circulation system; and a ramp attached to the one or more walls of the ball receptacle and adjustable between a first length and a second length;

wherein the ramp comprises a first ramp portion and a second ramp portion; and wherein the second ramp portion is slidably engaged with the first ramp portion.

16. The device of claim 15, wherein the ramp is adjustable in length such that the device is positionable for use within a floor duct having a first width when the ramp is adjusted to the first length and positionable for use within a floor duct having a second width when the ramp is adjusted to the second length.

17. A method for using a device for golf putting, the method comprising:

placing the device on a flat surface, the device having:

a ball receptacle having one or more walls that define a cavity sized to receive a golf ball and a substantially open top;

a frame at least partially surrounding the ball receptacle, wherein the frame includes a plate member that extends outward from an upper portion of the one or more walls of the ball receptacle, wherein the plate member comprises a plurality of openings configured to allow a flow of air through the plate member when the device is placed over a duct outlet of a forced air circulation system;

a ramp attached to the one or more walls of the ball receptacle and adjustable between a first length and a second length; and adjusting the ramp in length such that the device is positionable for use on the flat surface to provide a path for a ball to roll from the flat surface, upwardly along the ramp, and into the ball receptacle;

placing the device into a floor duct; and adjusting the ramp in length such that the ramp extends within the floor duct at least partially between the ball receptacle and the floor duct to provide a path for a ball to roll from the flat surface, downwardly along the ramp, and into the ball receptacle.

18. The method of claim 17, wherein the ramp of the device comprises a first ramp portion and a second ramp portion.

19. The method of claim 17, wherein the ramp is slidable relative to a portion of the ball receptacle to adjust between the first length and the second length.

20. The method of claim 17, wherein the device further comprises one or more protrusions on at least one of a back side of the frame and a back side of the ball receptacle that are configured to prop up the device on the flat surface.

* * * * *